US006793519B2

(12) United States Patent
Otsuka et al.

(10) Patent No.: US 6,793,519 B2
(45) Date of Patent: Sep. 21, 2004

(54) ELECTRICAL CONNECTOR AND METHOD OF CONNECTING LEAD LINES THEREFOR

(75) Inventors: Hiroyuki Otsuka, Kusatsu (JP); Hiroyuki Ohigashi, Otsu (JP); Yasusuke Takahashi, Kamoto-gun (JP); Masahiko Tashiro, Yamaga (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/442,605

(22) Filed: May 20, 2003

(65) Prior Publication Data

US 2003/0220010 A1 Nov. 27, 2003

(30) Foreign Application Priority Data

May 27, 2002 (JP) ..... 2002-152867

(51) Int. Cl.[7] ..... H01R 11/20

(52) U.S. Cl. ..... 439/395; 439/460; 439/405

(58) Field of Search ..... 439/395, 402, 439/460, 405

(56) References Cited

U.S. PATENT DOCUMENTS

| | | | | | |
|---|---|---|---|---|---|
| 3,848,954 | A | * | 11/1974 | Sedlacek | 439/392 |
| 4,340,268 | A | * | 7/1982 | Scalera | 439/43 |
| 4,392,701 | A | * | 7/1983 | Weidler | 439/76.1 |
| 4,861,278 | A | * | 8/1989 | McBride et al. | 439/395 |
| 5,421,741 | A | * | 6/1995 | David et al. | 439/405 |

* cited by examiner

*Primary Examiner*—Tho D. Ta
(74) *Attorney, Agent, or Firm*—Beyer Weaver & Thomas LLP

(57) ABSTRACT

An electrical connector has lead lines each having a core line and a cover layer each electrically connecting a connection terminal with a clamped part and a compression terminal both affixed to a main body. One end part of each lead line is affixed to the clamped part of a corresponding connecting terminal and the other end parts of the lead lines are pressed together simultaneously into corresponding ones of the compression terminals while the lead lines are supported by guide members having indentations such that the load on the clamped parts can be reduced as lead lines are forced into slits formed in the compression terminals and their cover layers are removed such that the core lines and the compression terminals come to contact each other.

4 Claims, 6 Drawing Sheets

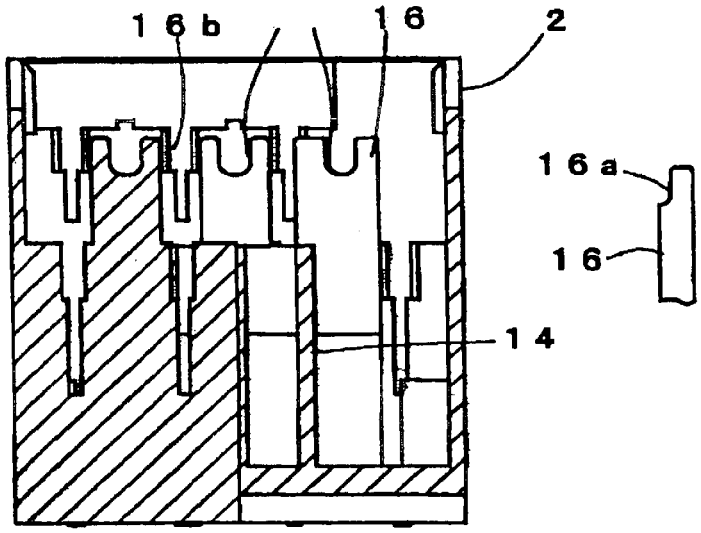
FIG. 6A
FIG. 6B
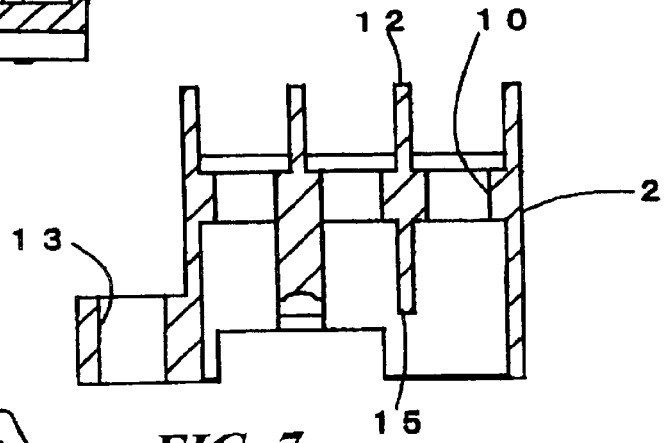
FIG. 7
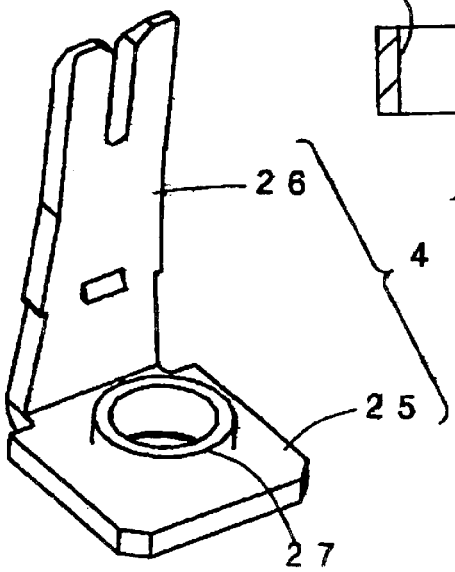
FIG. 8A
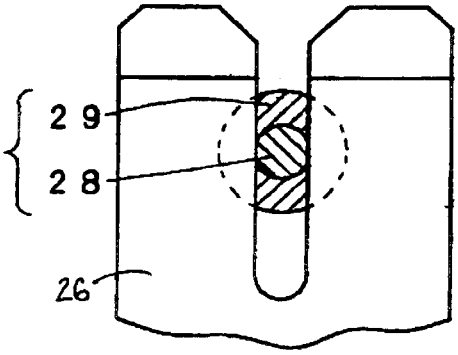
FIG. 8B

ELECTRICAL CONNECTOR AND METHOD OF CONNECTING LEAD LINES THEREFOR

BACKGROUND OF THE INVENTION

This invention relates to a connector for mounting an electronic component such as a relay and a timer or serving as a terminal table itself, as well as a method of connecting lead lines for such an electrical connector.

Electrical connectors for mounting an electronic component such as a relay are usually provided with a plurality of terminals which are mutually connected with lead lines. After one end part of each lead line is affixed to a terminal and pressed into the connector, the other end part of the lead line is soldered to another terminal affixed to the connector. Some connectors are structured with terminals formed with a series of plate materials such that lead lines are dispensed with. Japanese Patent Publications Tokkai 9-163555 and 8-223741, for example, disclose connectors adapted to connect lead lines with terminals by compression, that is, by using compression terminals and pressing lead lines into them such that their cover layers are torn and removed.

Methods of using lead lines to connect between terminals are troublesome because a cumbersome soldering work is required whenever a lead line is to be connected and their work efficiency is accordingly low. Another problem with these methods is that the lead line is subjected to a tensile force at the time of the soldering work such that a load force is applied to the compressed section and hence that the condition of the connection is adversely affected.

If the connector is formed with a series of planar materials, as explained above, each planar material must be designed in a different shape such that they can be disposed inside the connector in a mutually non-contacting manner. Since these planar materials are produced by press working or stamping, many expensive molds must be provided and this affects the cost of production adversely.

When compression terminals are used in a connector, furthermore, they must be positioned within a limited small space inside the connector for inserting lead lines thereinto. Workability of such an operation is very poor. Since the lead lines cannot be bent too gently within the narrow space inside the connector, it is difficult to keep them in a sufficiently dependably connected condition with respect to the compression terminal. In fact, compression terminals have not generally been used for the connection within a small space such as inside an electrical connector.

SUMMARY OF THE INVENTION

It is therefore an object of this invention to provide an electrical connector of a simple structure adapted to connect lead lines to terminals by compression so as to obtain a dependably connected condition.

It is another object of the invention to provide a method of connecting lead lines for such a connector.

An electrical connector embodying this invention may be characterized as comprising lead lines each having a core line and a cover layer therearound, connection terminals each having a clamped part and being affixed to one end of a corresponding one of these lead lines at the clamped part, compression terminals each having the other end of a corresponding one of the lead lines pressed thereinto so as to remove the cover layer and to electrically connect with the core line at the other end, and a main body containing the lead lines, the connection terminals and the compression terminals, the main body having guide members for contacting the cover layers of the lead lines and reducing loads onto the clamped parts as the lead lines are pressed into the compression terminals. With a connector thus structured, the terminals can be electrically connected merely by affixing connection terminals each attached to a lead line and compression terminals to the main body of the connector and pressing each of the lead lines into a corresponding one of the compression terminals. As the lead lines are thus pressed into the compression terminals, the cover layers of the lead lines come to contact the guide members such that the load force acting on the clamped part of each connection terminal can be reduced. Thus, the condition of connections is not adversely affected and the electrical connection can be established although the available space inside the connector is limited. Indentations may be preferably provided to these guide members at upper edge parts for positioning the lead lines in a mutually aligned manner. In this manner, a plurality of lead lines can be pressed into the compression terminals and hence workability can be improved.

According to a preferred embodiment of the invention, each of the compression terminals has an entry position defined therethrough at which the corresponding lead line is pressed thereinto, the compression terminals are set to the main body such that some of the compression terminals are upper terminals each having the entry position on a higher step and the others of the compression terminals are lower terminals each having the entry position on a lower step different from the upper step, some of these guide members are first guide members each corresponding to one of the upper terminals and the others are second guide members each corresponding to one of the lower terminals, each of the first guide members contacts at an upper edge part a corresponding one of the lead lines pressed into a corresponding one of the upper terminals. This serves to reduce the load force on the associated one of the connection terminal, and each of the lead lines pressed into a corresponding one of the lower terminals is guided between a corresponding one of mutually adjacent pairs of the first guide members. In this manner, the narrow interior space of the main body can be efficiently utilized even if there are many lead lines and terminals.

It is further preferable to produce each of the compression terminals by pressing an electrically conductive planar material so as to have an attachment part with a slit that serves to have one end of a lead line pressed therethrough and an insertion part for being pressed into the main body. The cover layer is thereby removed and the core line becomes electrically connected with the compression terminal. The planar material preferably has a thickness greater than the width of the slit such that the compression terminal and the core line contact each other over a specified sufficiently large contact area therebetween. It is preferable still further that the compression terminals be made of a material with electrical conductivity greater than 40% IACS and percentage of stress relaxation less than 5%.

A method according to this invention of electrically connecting a plurality of lead lines each to a pair of terminals affixed to a main body of such an electrical connector as described above may be characterized as comprising the steps of affixing one of end parts of each of the lead lines to a clamped part of a connection terminal, affixing these connection and compression terminals to the main body, and pressing each of the other end parts of the lead lines into corresponding one of the compression terminals simultaneously by contacting guide members to the cover layers of the lead lines so as to reduce loads on the clamped part and remove a portion of the cover layer and directly contact the core line with the compression terminal. These lead lines may be pressed into the connection terminals simultaneously together by pressing the compression terminals from both sides while the lead lines are in guided condition, being supported by guiding members. Thus, the work efficiency can be significantly improved.

BRIEF DESCRIPTION OF THE DRAWINGS

FIG. 6A is a sectional view taken along line 6A—6A of FIG. 4 and FIG. 6B is a front view of another guide member with a differently shaped gap.

FIG. 7 is a sectional view taken along line 7—7 of FIG. 4.

FIG. 8A is a diagonal view of a compression terminal shown in FIG. 1 and FIG. 8B is an enlarged front view of its attachment part.

DETAILED DESCRIPTION OF THE INVENTION

Figure 1:
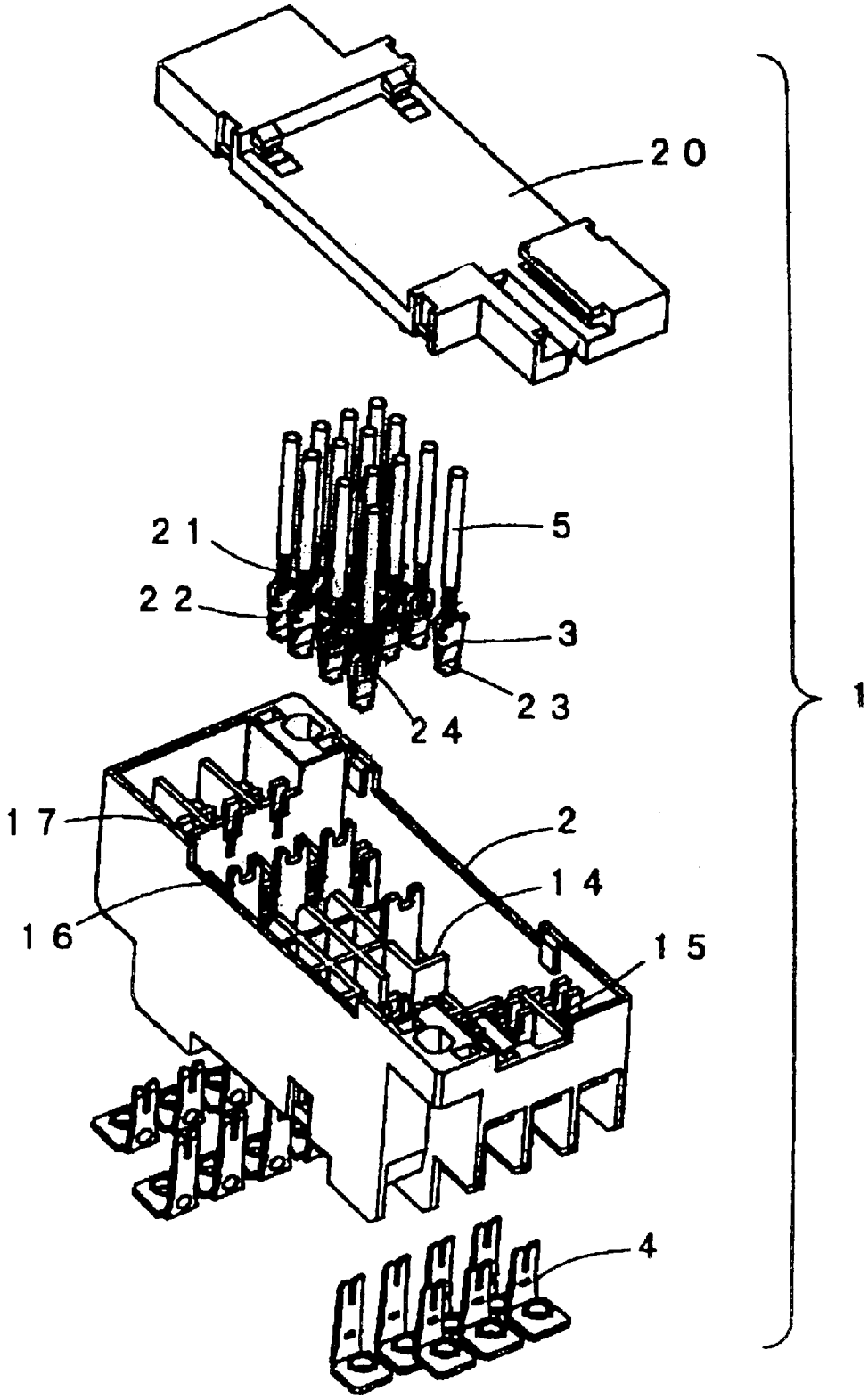
FIG. 1 is a diagonal view of an electrical connector embodying this invention taken from a downward direction before it is assembled.
Figure 2:
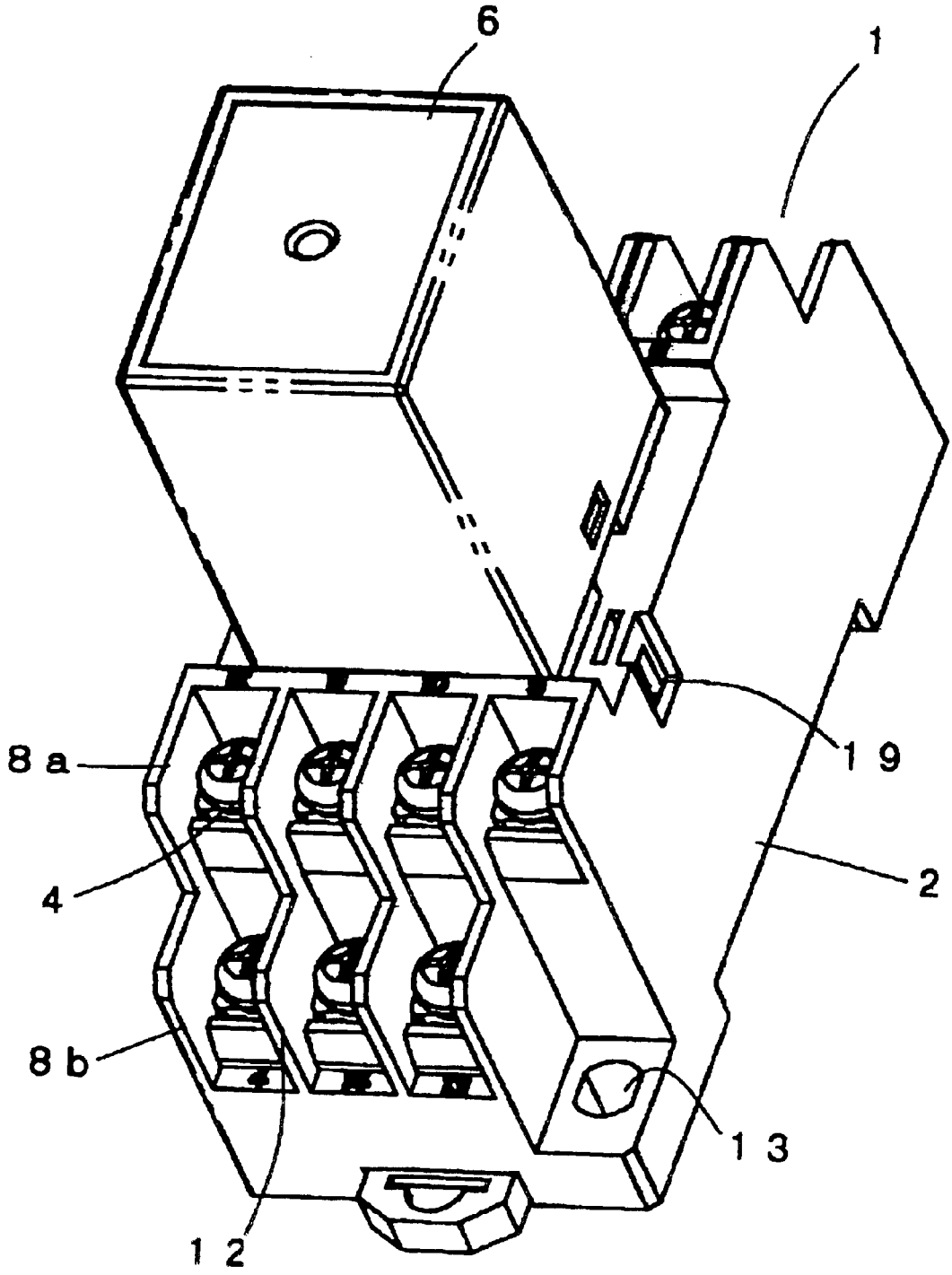
FIG. 2 is a diagonal view of the assembled electrical connector of FIG. 1 with a relay mounted thereto.

The invention is described next by way of an example. FIG. 1 shows an electrical connector 1 embodying this invention having connection terminals 3 and compression terminals 4 pressed in and affixed to an main body 2 and lead lines 5 affixed to the connection terminals 3 and pressed against the compression terminals 4. The main body 2 is an integrally formed molded structure of a synthetic resin material. As shown in FIG. 3A, a center part of its top surface is shaped to receive a relay (shown at 6 in FIG. 2) and has it mounted thereon, being provided with a plurality of openings ("terminal openings") 7 for having the terminals of the relay 6 inserted therein and also for having the connecting terminals 3 set therein. As shown in FIG. 2, two steps are formed at both end portions of the main body 2 with an upper step 8*a* and a lower step 8*b* such that the compression terminals 4 are in two levels. Four attachment areas 11, each having a circular hole 9 and an elongated hole 10, are provided on the upper step 8*a* and three such attachment areas 11 are on the lower step 8*b* mutually next to one another in a transverse direction on each of the end portions of the main body 2, as shown in FIG. 3A, each for having one of the compression terminals 4 attached thereon. For example, these attachment areas 11 may be arranged such that each mutually adjacent pair of the compression terminals 4 attached thereon has an interval of 6 mm therebetween. As shown in FIGS. 3A and 7, each mutually adjacent pair of the attachment areas 11 is separated by an upper partition wall 12. A screw hole 13 is formed on the lower step 8*b* adjacent to the three attachment areas 11 for attaching the main body 2 to a specified structure.

Figure 3B:
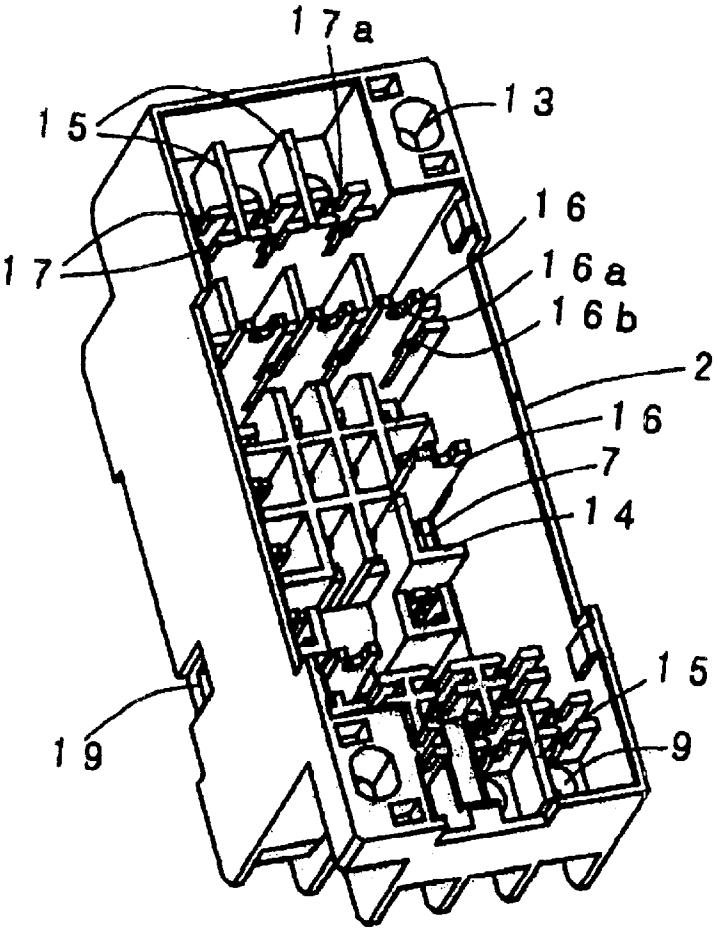
FIGS. 3A and 3B, together referred to as FIG. 3, are diagonal views of the main body of the electrical connector of FIG. 1 taken respectively from an upward direction and a downward direction.
Figure 3A:
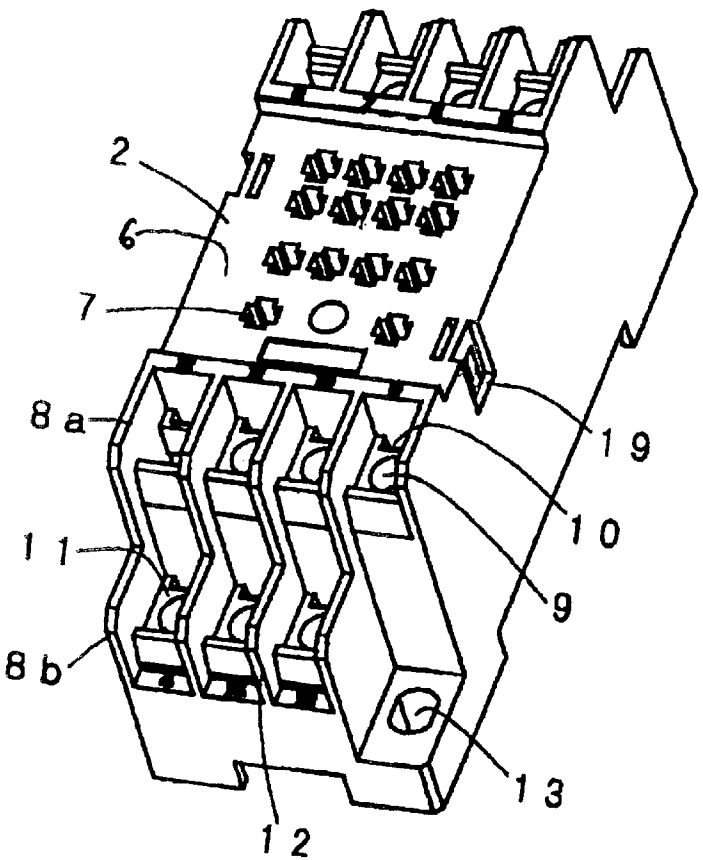
Figure 4:
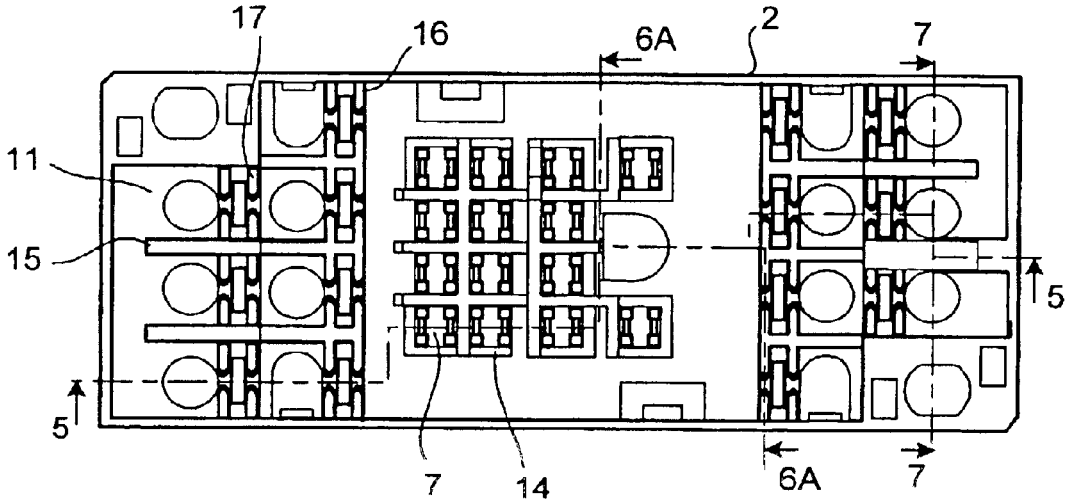
FIG. 4 is a bottom view of the main body of the electrical connector of FIG. 1.
Figure 5:
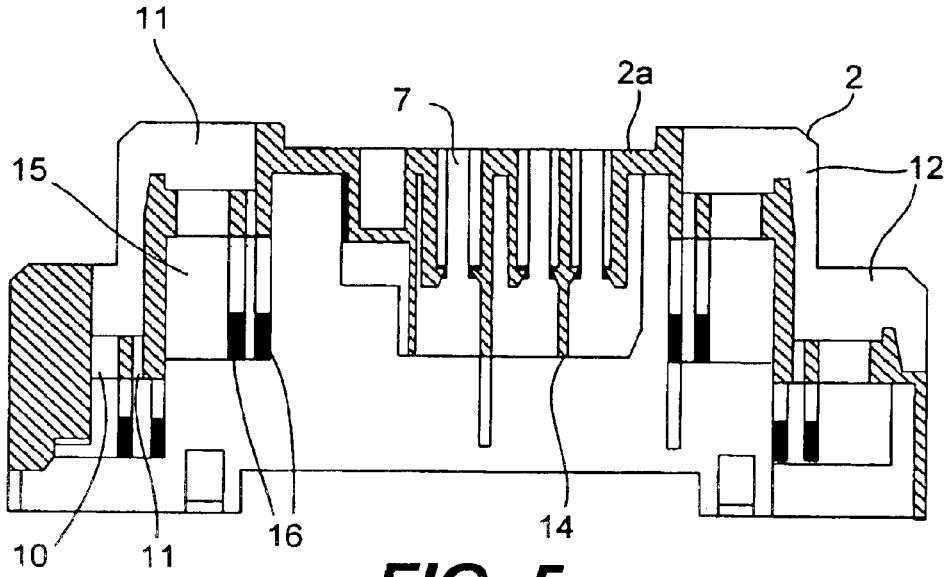
FIG. 5 is a sectional view taken along line 5—5 of FIG. 4.

As shown in FIGS. 1 and 3B, the bottom surface of the main body 2 is open such that the connection and compression terminals 3 and 4 can be attached therethrough. Each of the terminal openings 7 is surrounded by guide members ("first guide members") 14 serving as partitions. The separation between each mutually adjacent pair (or the pitch) of the connection terminals 3 attached to these openings 7 is relatively small (such as 4.1 mm according to this example). The tip (bottom edge) parts of the first guide members 14 protrude farther than the compressed sections of the connection terminals 3 attached to the lead lines 5 so as to contact the lead lines 5.

The attachment areas 11 are mutually separated by walls ("lower partition walls" 15) as shown in FIGS. 1, 3B, 4 and 5. Three guide members ("second guide members 16") are formed at three places corresponding to the attachment areas 11 on the upper step 8*a*, or to the lower partition walls 15 that separate them in the transverse direction. Each second guide member 16 has a guide indentation 16*a* formed in the middle at the top such that its lower edge still protrudes from the portion fastened to the connecting terminal 3. The width of the guide indentation 16*a* should be sufficiently large for positioning the lead line 5. FIG. 3B shows the guide indentations 16*a* to be approximately semi-circular but they may be elongated as shown in FIG. 6B as long as the lead lines 5 can be arranged without overlapping too much and the contact force between the lead lines 5 and the connection terminals 3 can be relaxed as the lead lines 5 are connected to the compression terminals 4.

Gaps 16*b* between the second guide members 16 can also serve to guide the lead lines 5. In other words, those of the lead lines 5 running towards the attachment area 11 on the upper step 8*a* are guided through the guide indentations 16*a* at the tips of the members 16, while those lead lines 5 running towards the attachment areas 11 on the lower step 8*b* are guided through those gaps 16*b*. These gaps 16*b* serve to guide the lead lines 5 to neighborhoods of the terminal openings 7 so as to prevent the lead lines 5 extending from the connection terminals 3 from crossing one another.

As shown in FIGS. 1 and 2B, a pair of walls ("third guide members" 17) is provided near the circular and elongated holes 9 and 10 of the three attachment areas 11 on the lower step 8*b* separated from each other by a specified distance. Each of these walls 17 has a groove 17*a* in the middle at the top for securing a lead line 5. Portions of the first guide members 14 may be extended to form the second guide members 16. In other words, the first and second guide members may be freely designed, depending on the patterns of the lead lines 5. In FIGS. 2 and 3, numeral 19 indicates an opening for engaging a holding member (not shown) for securing the relay 6 to the main body 2. In FIG. 1, numeral 20 indicates a cover member for covering the open bottom surface of the main body 2.

The connection terminals 3, produced by pressing an electrically conductive planar material, each comprise a clamped part 21 where it is clamped to an end of a lead line 5 and a tip 22 to be inserted into the terminal hole 7 of the main body 2. The tip 22 comprises a pair of mutually corresponding clamping members 23 between which a terminal of the relay 6 is to be inserted. An engagement member 24 to be engaged with an inner wall of the terminal opening 7 of the main body 2 is formed on the base part of one of the claming members 23. The lead line 5 and the connection terminal 3 need not be secured to each other by clamping. They may be soldered or welded together.

As shown in FIG. 8, the compression terminals 4 are each approximately L-shaped, having a base part 25 to be electrically connected to a terminal (not shown) and an approximately U-shaped attachment part 26 to which the core line 28 of the lead line 5, after its cover layer 29 is removed, is to be attached so as to be electrically conductive to each other. Such compression terminals 4 can be produced also by pressing or stamping an electrically conductive planar material. A plate with thickness of about 0.8 mm is used because a female screw part 27 (also referred to as the "insertion part") to be explained below is provided by a burring process such that a sufficiently large contact area can be secured with the core line 28. A material with electrical conductivity greater than 40% IACS and percentage of stress relaxation (defined as (t1−t2)/t1 where t1 is the load when the sample is stretched to a specified length and t2 is the load after it has been left without any tensile force for a specified length of time) less than 5% such as a copper alloy is preferable. A material with electrical conductivity greater than 40% IACS is preferred because the temperature rise due to generation of heat can be controlled even if the current intensity therethrough is large such as 10A. The stress relaxation percentage of less than 5% is preferable because the compressed condition between the core line 28 and the attachment part 26 can be maintained in a good condition for a long period of time.

The female screw part 27 is formed at the center of the base part 25. If a material of thickness 0.8 mm is subjected to a burring process, a tubular shape with a sufficient height such as 2 mm can be formed, allowing a female screw with pitch 0.5 mm to be fabricated therefrom. The female screw part 27 thus produced is pressed inside the circular hole 9 of the main body 2. A matching male screw is thereafter screwed in to secure the terminal.

The slit that is formed in the attachment part 26 is 0.67 mm in width, that is, its width is smaller than the thickness of its material. More in detail, the slit width is to be determined, depending on the elastic and plastic deformations of the attachment and the scraped amount of the core line 28 such that a sufficiently large contact area can be secured even with the core line 28 of a thin, easily deformable lead line 5 for a reliable electrical connection.

As shown in FIG. 8B, the lead line 5 has the core line 28 covered with the cover layer 29. The cover layer 29 is removed at one end and the portion of the core line 28 which becomes exposed is clamped and secured by the clamped part 21 of the connection terminal 3. The other end of the lead line 5 is directly pressed into the attachment part 26 so as to tear away the cover layer 29 to make a contact between the core line 28 and the attachment part 26. In this example, the outer diameters of the lead line 5 and the core line 28 are respectively 1.81 mm and 0.81 mm such that the lead lines 5 can be freely deformed even inside the small space inside the main body 2 (or 71 mm×29 mm according to this example). If a lead line according to this example is pressed into the attachment part as described above, the contact area on each side becomes 0.8 mm×0.3 mm, that is, the total contact area on both sides becomes 0.48 $mm^2$, which is sufficiently large for maintaining a good electrically conductive condition.

To assemble the electrical connector 1 of FIG. 1, the connection terminals 3 are preliminarily attached to the lead lines 5 at one end and inserted to the terminal openings 7 from the bottom side of the main body 2. The compression terminals 4 are individually secured to the attachment areas 11. After the connection and compression terminals 3 and 4 are thus positioned, the lead lines 5 are deformed each to the attachment part 26 of the corresponding one of the compression terminals 4. Since the lead lines 5 are dimensioned as explained above, they can be bent easily. Some of the lead lines 5 are each hooked from the first guide member 14 to the guide indentation 16*a* of the second guide member 16 to be positioned on the attachment part 26 of a compression terminal 4 on the lower step 8*b* while some of them are each hooked to the gap 16*b* from the first guide member 14 to the groove 17*a* of the third guide member 17, or the attachment part 26 of the compression terminal 4 on the upper step 8*a*. Thus, the lead lines 5 can be arranged in a neatly aligned manner, unlike the prior art examples wherein lead lines were randomly crossed and the work efficiency was poor. In particular, the lead lines 5 connected to the compression terminals 4 on the upper step 8*a* are short (30 mm in this example) but since they can be guided to the gaps 18*b*, the workability is significantly improved.

Figure 9:
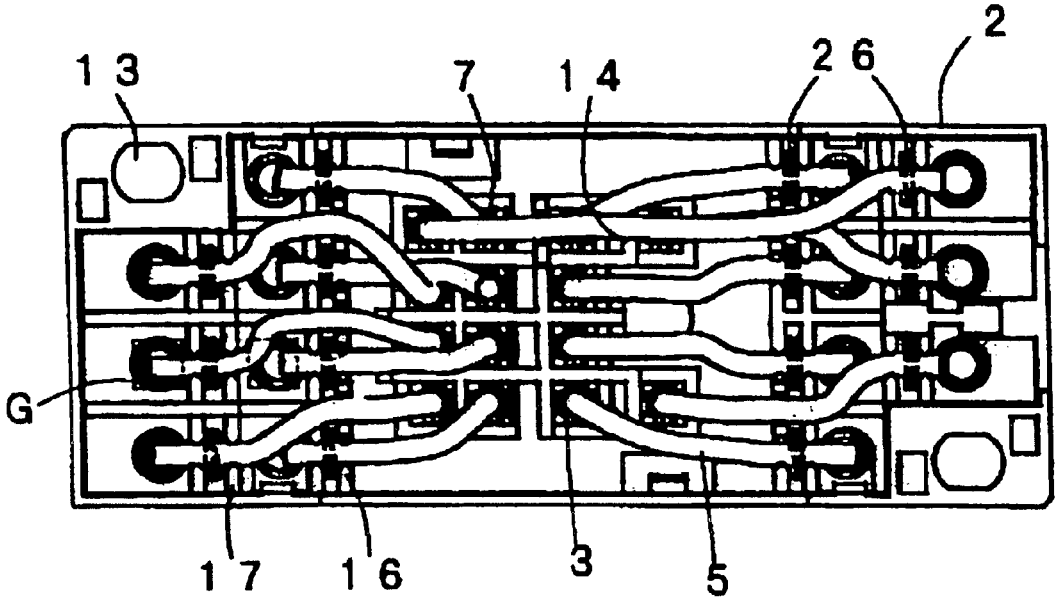
FIG. 9 is a bottom view of the electrical connector of this invention with the cover removed.
Figure 10:
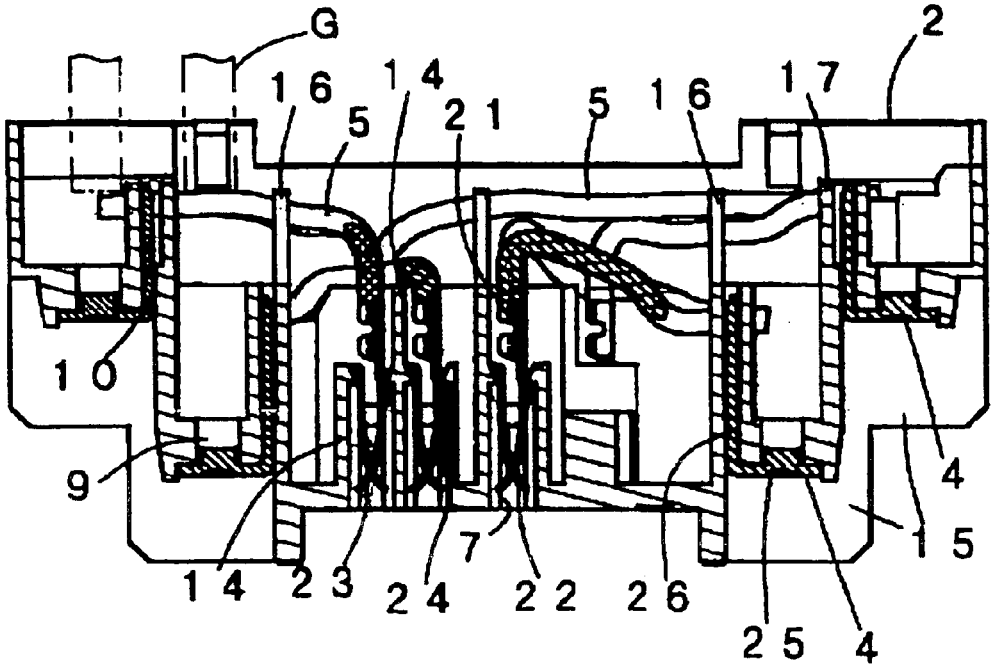
FIG. 10 is a sectional view of the electrical connector of this invention.

Since the lead lines 5 can be neatly aligned, the subsequent compressing work by a tool can be carried out efficiently at once. For example, if the tool is shaped as shown by letter G in FIGS. 9 and 10 such that both sides of the attachment part 26 of the compression terminal 4 can be pressed, several or all of the lead lines 5 may be pressed together simultaneously to complete the wiring. In the example shown herein, there are as many as fourteen lead lines 5 to be arranged but the work can be completed quickly and efficiently as explained above.

Tensile forces are applied to the lead lines 5 when they are compressed but since the first guide member 14 or the guide indentation 16*a* of the second guide member 16 contacts the cover layer 29, the lead line 5 can be bent around the tip parts. Thus, the tensile force is prevented from directly affecting the neighborhood of the clamped part 21 of the connection terminals 3, shown crosshatched in FIG. 10. In other words, the condition of the clamped part 21 is not adversely affected and adequate electrically conductive condition can be maintained. The lead lines 5 pressed through the compression terminals 4 have their cover layers 29 removed by the mutually opposite edges of the attachment part 26 and also can maintain a good electrically conductive condition with a sufficient contact area between the core line 28 and the tip part 22.

As a relay 6 is mounted to the connector 1 thus formed, the terminals of the relay 6 are pressed into the trip parts 22 of the connection terminals 3. Since the connection terminals 3 are engaged only with the terminal openings 7 of the main body 2, they may rattle a little, causing also the lead lines 5 to rattle when the relay 6 is mounted. Since the lead lines 5 contact the first and second guide members 14 and 16, however, the rattling is not communicated to the compression terminals 4.

Although the invention was disclosed above for the mounting of a relay but this is not intended to limit the scope of the invention. The connector of the invention may be used for mounting a timer, and the connector itself may be used as a terminal table. As should be clear from the disclosure above, the present invention makes it possible to attach lead lines to compression terminals dependably because guide members are provided so as to contact the cover layers of the lead lines and to thereby reduce the load on the portions where connection terminals are connected although the space inside the connector is limited.

What is claimed is:

1. An electrical connector comprising:

lead lines each having a core line and a cover layer around said core line;

connection terminals each having a clamped part and being affixed to one end of a corresponding one of said lead lines at said clamped part;

compression terminals each having the other end of a corresponding one of said lead lines pressed thereinto so as to remove said cover layer and to electrically connect with said core line at the other end; and a main body containing said lead lines, said connection terminals and said compression terminals, said main body having guide members that contact the cover layers of said lead lines and reduce loads onto the clamped parts as said lead lines are pressed into said compression terminals; wherein:

each of said compression terminals has an entry position defined therethrough at which the corresponding lead line is pressed thereinto;

said compression terminals are set to said main body such that some of said compression terminals are upper terminals each having the entry position on a higher step and the others of said compression terminals are lower terminals each having the entry position on a lower step, said higher step and said lower step being different steps;

some of said guide members are first guide members each corresponding to one of said upper terminals and the others of said guide members are second guide members each corresponding to one of said lower terminals;

each of said first guide members contacts at an upper edge part a corresponding one of said lead lines pressed into a corresponding one of the upper terminals and thereby reduces the load force on the associated one of said connection terminals; and each of the lead lines pressed into a corresponding one of the lower terminals is guided between a corresponding one of mutually adjacent pairs of the first guide members.

2. The electrical connector of claim 1 wherein said guide members have indentations at upper edge parts for positioning said lead lines in a mutually aligned manner.

3. The electrical connector of claim 1 wherein:

each of said compression terminals is produced by pressing an electrically conductive planar material and has an attachment part with a slit that serves to have one end of one of said lead lines pressed therethrough such that the cover layer is removed and the core line becomes electrically connected with said compression terminal and an insertion part for being pressed into said main body; and said planar material has a thickness greater than the width of said slit such that said compression terminal and said core line contact each other over a specified contact area therebetween.

4. The electrical connector of claim 1 wherein said compression terminals are made of a material with electrical conductivity greater than 40% IACS and percentage of stress relaxation less than 5%.

* * * * *